US007145525B2

(12) United States Patent
Mizobata

(10) Patent No.: US 7,145,525 B2
(45) Date of Patent: Dec. 5, 2006

(54) AC PLASMA DISPLAY PANEL AND DRIVING METHOD THEREFOR

(75) Inventor: Eishi Mizobata, Tokyo (JP)

(73) Assignee: Pioneer Corporation, Tokyo (JP)

( * ) Notice: Subject to any disclaimer, the term of this patent is extended or adjusted under 35 U.S.C. 154(b) by 180 days.

(21) Appl. No.: 10/296,544

(22) PCT Filed: May 29, 2001

(86) PCT No.: PCT/JP01/04479

§ 371 (c)(1),
(2), (4) Date: Nov. 25, 2002

(87) PCT Pub. No.: WO01/93297

PCT Pub. Date: Dec. 6, 2001

(65) Prior Publication Data

US 2003/0189532 A1 Oct. 9, 2003

(30) Foreign Application Priority Data

May 31, 2000 (JP) ..... 2000-163424

(51) Int. Cl.
*G09G 3/28* (2006.01)

(52) U.S. Cl. ..... 345/63; 345/60; 345/64; 345/66; 345/67; 345/68

(58) Field of Classification Search ..... 345/63, 345/60, 64, 66–68
See application file for complete search history.

(56) References Cited

U.S. PATENT DOCUMENTS 6,072,457 A * 6/2000 Hashimoto et al. ..... 345/100
6,384,802 B1 * 5/2002 Moon ..... 345/60

FOREIGN PATENT DOCUMENTS

| | | | |
|---|---|---|---|
| JP | 02-220330 | A | 9/1990 |
| JP | 06-44907 | A | 2/1994 |
| JP | 09-160525 | A | 6/1997 |
| JP | 09-244573 | A | 9/1997 |
| JP | 10-321148 | A | 12/1998 |
| JP | 11-65518 | A | 3/1999 |
| JP | 11-96919 | A | 4/1999 |
| JP | 11-161227 | A | 6/1999 |
| JP | 11-317171 | A | 11/1999 |
| JP | 2000-11899 | A | 1/2000 |

* cited by examiner

*Primary Examiner*—Richard Hjerpe
*Assistant Examiner*—Leonid Shapiro
(74) *Attorney, Agent, or Firm*—Sughrue Mion, PLLC

(57) ABSTRACT

In a three-electrode AC plasma display panel, a plurality of X electrodes (22) and a plurality of Y electrodes (23) are alternately arranged parallel to each other on one of two, front and rear insulating substrates (20, 21) opposing each other, and a plurality of data electrodes (29) are arranged on the other insulating substrate to cross the X and Y electrodes (22, 23) at right angles. In this panel, cell separation partition walls (33) are arranged on the front insulating substrate, on which the X and Y electrodes (22, 23) are arranged, along the X and Y electrodes (22, 23). In a driving method for the three-electrode AC plasma display panel, progressive display is performed depending on whether discharge simultaneously occurs between all the adjacent pairs of X and Y electrodes (22, 23).

11 Claims, 16 Drawing Sheets

AC PLASMA DISPLAY PANEL AND DRIVING METHOD THEREFOR

TECHNICAL FIELD

This invention relates to an AC plasma display panel and a driving method therefor.

BACKGROUND ART

In general, a plasma display panel (to be also abbreviated to PDP hereinafter) has many advantages, e.g., having a low profile, allowing large-screen display with relative ease, providing a wide viewing angle, and having a high response speed. Owing to these advantages, plasma display panels have recently been used as flat displays, wall-mounted TV sets, and public display boards. PDPs are classified into direct current discharge type (DC) PDPs and alternating current discharge type (AC) PDPs according to their operation schemes. A DC PDP is designed to operate in a direct current discharge state in which electrodes are exposed to a discharge space (discharge gas). An AC PDP is designed to operate in an alternating current discharge state in which electrodes are covered with dielectric layers and are not directly exposed to a discharge gas. In a DC PDP, discharge is caused during a period in which a voltage is applied. In an AC PDP, discharge is sustained by reversing the polarity of a voltage. In addition, AC PDPs include a PDP having two electrodes in one cell and a PDP having three electrodes in one cell.

The structure of a conventional three-electrode AC plasma display panel and a method of driving the panel will be described below. FIGS. 1 and 2 are plan and sectional views each showing an example of a conventional three-electrode AC plasma display panel. This three-electrode AC plasma display panel includes a front substrate 20 and rear substrate 21 which face each other, X electrodes 22, Y electrodes 23, and data (address) electrodes 29 which serve as display electrodes for surface discharge and are arranged between the two substrates 20 and 21, and display cells 31 (see FIG. 1) arranged at the intersections of the X electrodes 22, Y electrodes 23, and data electrodes 29 in the form of a matrix.

A glass substrate or the like is used as the front substrate 20. The X and Y electrodes 22 and 23 are arranged at predetermined intervals. Metal electrodes 32 are stacked on the X and Y electrodes 22 and 23 to decrease the wiring resistance. A transparent dielectric layer 24 and a protective layer 25 which is made of MgO or the like and protects the transparent dielectric layer 24 against discharge are formed on these electrodes. A glass substrate or the like is used as the rear substrate 21, on which the data electrodes 29 are arranged to cross the X and Y electrodes 22 and 23 at right angles. A white dielectric layer 28 and phosphor layer 27 are formed on the data electrodes 29. A plurality of partition walls 35 are formed parallel to each other at predetermined intervals between the two glass substrates. The partition walls 35 serve to ensure a discharge space 26 and separate pixels from each other. A gas mixture of He, Ne, Xe, and the like is sealed in the discharge space 26. Such a structure is disclosed in SID 98 DIGEST, pp. 279–281, May, 1998.

Referring to FIG. 1, reference numeral 30 denotes a display screen. Display cells 31 are arranged at the intersections of electrodes Xi (i=1 to m) as the X electrodes 22, Yi electrodes as the Y electrodes 23, and electrodes Dj (j=1 to n) as the data electrodes 29 in the form of a matrix.

A method of driving this three-electrode AC plasma display panel will be described next. Today, the dominating driving method is the ADS (Address/Display Separation) scheme of separating an address period from a sustain period (display period). A driving method based on this address/display separation scheme will be described below. FIG. 3 is a timing chart showing one sub-field 1 (to be abbreviated to SF hereinafter) in a three-electrode AC plasma display panel. One sub-field 1 is constituted by three periods, namely a priming (rest) period 2, address period 3, and sustain period 4.

The priming period 2 will be described first. Positive and negative priming pulses 5 and 6 are respectively applied to the X and Y electrodes 22 and 23. This produces a priming effect. That is, the difference between the formation state of wall charge at the end of the preceding SF and that of the current SF due to the emission state of the preceding SF is reset to achieve initialization, and all pixels are forced to discharge, thereby preparing for writing discharge at a low voltage afterward. Referring to FIG. 3, the positive and negative priming pulses 5 and 6 are applied once. In some cases, however, a sustain eliminating pulse for resetting the state of the preceding SF is applied first, and then a priming pulse for producing a priming effect by making all pixels discharge is applied. In this manner, pulses with two different roles may be separately applied. In this case, the number of times a sustain eliminating pulse is applied is not limited to one, and different pulses may be applied a plurality of number of times.

A priming effect is not always required for each SF. In some driving methods, therefore, a priming pulse is applied only once for every several SFs. Since a priming pulse causes all pixels to emit light regardless of display, the luminance in a black display period can be suppressed low by decreasing the number of times of application of a priming pulse. As in the prior art shown in FIG. 3, when the priming pulse 5 or 6 is to be used, in order to produce the priming effect of forcing all pixel to discharge once for every several SFs, the priming pulse 5 or 6 may be reduced in level to have only a resetting function in SFs other than the one shown in FIG. 3. In this case, different pulses may be applied a plurality of number of times instead of a priming pulse to reliably reset.

The address period 3 follows the priming period 2. In the address period 3, an address pulse 8 is sequentially applied to the electrodes X1 to Xm as the X electrodes 22. In synchronism with this address pulse 8, a data pulse 9 is applied to the electrodes D1 to Dn as the data electrodes 29 in accordance with a display pattern. In a pixel to which the data pulse 9 is applied, since a high voltage is applied between the X electrode 22 and the data electrode 29, writing discharge occurs to form a large amount of positive wall charge on the X electrode 22 side and negative wall charge on the data electrode 29 side. In a pixel to which no data pulse 9 is applied, since the applied voltage decreases, no discharge occurs, resulting in no change in wall charge state. As described above, two types of wall charge states can be produced depending on the presence/absence of the data pulse 9. The hatch lines corresponding to the data pulse 9 in FIG. 3 indicate that the data pulse 9 is present or absent depending on display data.

When application of the address pulse 8 to all electrode lines is complete, the address period 3 shifts to the sustain period 4. A sustain pulse 10 is alternately applied to all the X electrodes 22 and all the Y electrodes 23. The voltage of the sustain pulse 10 is set to a voltage at which no discharge is caused by the voltage itself. For this reason, in a pixel in which no writing discharge is caused, since wall discharge is small in amount, even if a sustain pulse is applied, no discharge occurs. In contrast to this, in a pixel in which writing discharge is caused, since a large amount of positive wall charge exists on the X electrode 22 side, this positive wall charge is superimposed on the first positive sustain pulse (to be referred to as the first sustain pulse) applied to the X electrode 22, thereby applying a voltage higher than the discharge start voltage in a discharge space. As a consequence, sustain discharge occurs. With this discharge, negative wall charge is stored on the X electrode 22 side, and positive wall charge is stored on the Y electrode 23 side.

The next sustain pulse (to be referred to as the second sustain pulse) is applied to the Y electrode 23 side. In this case as well, since the above wall charge is superimposed on this pulse, sustain discharge occurs, and wall charge having the opposite polarity to the first sustain pulse is stored on the X electrode 22 side and Y electrode 23 side. Subsequently, discharge continuously occurs on the same principle as described above. That is, the potential difference due to the wall charge produced by the xth sustain discharge is superimposed on the (x+1)th sustain pulse to maintain sustain discharge. The light emission amount is determined by the number of times this sustain discharge is maintained.

The above reset period 2, address period 3, and sustain period 4, which constitute a sustain eliminating period, will be referred to as a sub-field 1 as a whole. When gray-scale display is to be performed, one field which is a period in which one-frame image information is displayed is constituted by a plurality of sub-fields 1. The number of sustain pulses in each sub-field 1 is changed to turn on or off each sub-field 1, thereby performing gray-scale display.

In the above structure and driving method, however, a non-discharge gap 37, which is the distance between the X electrode of a given cell and the Y electrode of an adjacent cell as in FIG. 1, must be set to be larger than a discharge gap 36. Therefore, the above structure and method are not suited to a high-resolution panel. In contrast to this, as a known panel structure and driving method which are suited to high resolution, for example, the plasma display panel driving method and plasma display panel apparatus disclosed in Japanese Unexamined Patent Publication No. 9-160525 are available. FIG. 4 is a plan view of the panel. This panel differs from the conventional panel in FIG. 1 in that one Y electrode is additionally formed on the upper portion, and all X and Y electrodes are arranged at equal intervals. In the prior art shown in FIG. 4, pixels are formed in the electrode gaps between all the X and Y electrodes, thus making this structure suitable for a high-resolution screen.

FIGS. 5 and 6 show a driving method for another prior art shown in FIG. 4. FIG. 5 shows driving waveforms in an odd-numbered field in the prior art shown in FIG. 4. FIG. 6 shows driving waveforms in an even-numbered field in the prior art shown in FIG. 4. The operation in a priming period 2 is the same as that in the prior art shown in FIG. 3. An address period 3 follows the priming period 2. In the address period 3, an address pulse 8 is sequentially applied to electrodes X1 to Xm as X electrodes 22. In synchronism with this address pulse 8, a data pulse 9 is applied to electrodes D1 to Dn as data electrodes 29 in accordance with a display pattern. FIG. 7 shows how the data pulse 9 is applied in this case. Referring to FIG. 7, electrodes Y1 to X3 are placed in a line on a given data electrode in FIG. 4. In the case shown in FIG. 7, ON/OFF display like that indicated at the upper portion in the drawing is performed. This driving method is interlaced driving. Therefore, in an odd-numbered field, the first, third, and fifth pixels, viewed from the left, are displayed. In an even-numbered field, the second and fourth pixels are displayed.

An odd-numbered field will be described first. Since only the first pixel of the first, third, and fifth pixels is an ON pixel, the data pulse 9 is applied only when the address pulse 8 is applied to the electrode X1 as the X electrode 22 corresponding to the first pixel. When application of the address pulse 8 to all the lines is complete, the sustain period 4 starts. In an odd-numbered field, the odd-numbered X electrodes and even-numbered Y electrodes are in phase, and so are the even-numbered X electrodes and odd-numbered Y electrodes. For this reason, in a pixel in which wall charge is formed in an address period, sustain discharge occurs between the odd-numbered X electrode and the odd-numbered Y electrode and between the even-numbered X electrode and the even-numbered Y electrode. In the prior art shown in FIG. 7, although no sustain discharge occurs at the first sustain timing, sustain discharge starts from the second sustain timing and is maintained thereafter. When no wall charge is formed in odd- and even-numbered fields during an address period, no sustain discharge occurs.

An even-numbered field will be described next. Since both the second and fourth pixels are ON pixels, the data pulse 9 is applied at both timings at which the address pulse 8 is applied to the electrode X1 as the X electrode 22 corresponding to the second pixel and the electrode X2 as the X electrode 22 corresponding to the fourth pixel. When application of the address pulse 8 to all the lines is complete, the sustain period 4 starts. In an even-numbered field, the odd-numbered X electrode and odd-numbered Y electrode are in phase, and the even-numbered X electrode and even-numbered Y electrode are in phase. For this reason, in a pixel in which wall charge is formed during an address period, sustain discharge occurs between the odd-numbered X electrode and the odd-numbered Y electrode and between the even-numbered X electrode and the even-numbered Y electrode. In this case as well, although no sustain discharge occurs in the second pixel at the first sustain timing, sustain discharge starts from the second sustain timing as in an odd-numbered field and is maintained thereafter.

As described above, according to this driving method, by adding two fields, i.e., odd- and even-numbered fields, display can be performed between all the X and Y electrodes. This makes it possible to realize a high-resolution display.

As described above with reference to the first prior art, when progressive (non-interlaced) driving is to be used, only the discharge gaps between respective X and Y electrode pairs can be used for display. In contrast to this, when display is to be performed between all the X and Y electrodes, interlaced driving must be used.

DISCLOSURE OF INVENTION

The present invention has been made in consideration of the above situation in the prior art, and has as its object to provide an AC plasma display panel which can use the gaps between all X and Y electrodes for display by progressive (non-interlaced) driving and obtain high-resolution, high-quality images, and a driving method for the panel.

In order to achieve the above object, according to a first main aspect of the present invention, there is provided a three-electrode AC plasma display panel in which a plurality of X electrodes and a plurality of Y electrodes are alternately arranged parallel to each other on one of two, front and rear insulating substrates opposing each other, and a plurality of data electrodes are arranged on the other insulating substrate to cross the X and Y electrodes at right angles, comprising cell separation partition walls arranged on the front insulating substrate, on which the X and Y electrodes are arranged, along the X and Y electrodes, and a discharge separation partition wall having a height smaller than a distance between the two opposing insulating substrates formed on the insulating substrate, on which the data electrodes are arranged, at a position to oppose a discharge gap formed between the adjacent pair of X and Y electrodes.

The first main aspect has the following subsidiary aspects.

In the three-electrode AC plasma display panel according to the present invention, a width of the data electrode at a position opposing the discharge gap is smaller than a width of the data electrode at positions opposing the X and Y electrodes.

In the three-electrode AC plasma display panel according to the present invention, a width of the data electrode at a position opposing the center line of each of the X and Y electrodes is smaller than a width of the data electrode at a position opposing other portions of the X and Y electrodes.

In order to achieve the above object, according to a second main aspect of the present invention, there is provided a driving method for a three-electrode AC plasma display panel in which a plurality of X electrodes and a plurality of Y electrodes are alternately arranged parallel to each other on one of two, front and rear insulating substrates opposing each other, and a plurality of data electrodes are arranged on the other insulating substrate to cross the X and Y electrodes at right angles, comprising the steps of: causing adjacent two cells involving pairs of X and Y electrodes, to which an address pulse has been applied, to generate writing discharge simultaneously; and performing progressive display depending on the occurrence of discharge caused between respective pairs of X and Y electrodes involving in the adjacent two cells.

The second main aspect has the following subsidiary aspects.

The driving method for the three-electrode AC plasma display panel according to the present invention further comprises the steps of setting an address period and a sustain period, sequentially applying an address pulse to the X and Y electrodes in the address period, applying a data pulse corresponding to display data to the data electrode in accordance with the application timing of the address pulse, forming wall charge at the X and Y electrodes in accordance with the display data, applying an AC sustain pulse between the X and Y electrodes in the sustain period, and determining occurrence of sustain discharge on the basis of the amount of the wall charge, thereby performing display.

In the driving method for the three-electrode AC plasma display panel according to the present invention, when ON display is to be performed by causing discharge between each pair of X and Y electrodes, the pulses having different voltages are respectively applied to the X and Y electrodes upon application of the address pulse to cause writing discharge at only one of the X and Y electrodes in the address period, and when OFF display is to be performed by causing no discharge between each pair of X and Y electrodes, the pulses having the same voltage are applied to the X and Y electrodes upon application of the address pulse to cause writing discharge at both or neither of the X and Y electrodes.

In the driving method for the three-electrode AC plasma display panel according to the present invention, when ON display is to be performed by causing discharge between each pair of X and Y electrodes, the data pulses having different voltages are respectively applied to the X and Y electrodes upon application of the address pulse to cause writing discharge at only one of the X and Y electrodes in the address period, and when OFF display is to be performed by causing no discharge between each pair of X and Y electrodes, the data pulses having the same voltage are applied to the X and Y electrodes upon application of the address pulse to cause writing discharge at both or neither of the X and Y electrodes.

In the driving method for the three-electrode AC plasma display panel according to the present invention, a bias voltage having the same polarity as that of the address pulse is applied to two Y or X electrodes adjacent to the X or Y electrode to which at least the address pulse is applied in the address period.

In the driving method for the three-electrode AC plasma display panel according to the present invention, in the address period, when the address pulse is applied, no surface emission is caused between the electrode to which the address pulse is applied and the X or Y electrodes adjacent to the electrode to which the address pulse is applied.

In the driving method for the three-electrode AC plasma display panel according to the present invention, in the sustain period, discharge is caused between the X and Y electrodes in an ON cell every time a polarity of the AC sustain pulse is reversed, and the discharge is not caused in an OFF cell every time the AC sustain pulse is reversed.

In the driving method for the three-electrode AC plasma display panel according to the present invention, one field in which one frame is displayed is constituted by a plurality of sub-fields, each of the sub-fields has a priming period in which a stored state of wall charge in each cell is initialized, the address period, and the sustain period, and gray-scale display is realized by turning on or off the sustain period in an arbitrary sub-field.

In the driving method for the three-electrode AC plasma display panel according to the present invention, in the address period, the voltage of the data pulse to be applied first is changed depending on whether the data electrode is on an even- or odd-numbered line, thereby changing the presence/absence of the writing discharge.

In the driving method for the three-electrode AC plasma display panel according to the present invention, in the address period, the voltage of the data pulse to be applied first is changed depending on an even- or odd-numbered field, thereby changing the presence/absence of the writing discharge.

In the driving method for the three-electrode AC plasma display panel according to the present invention, a phase of the AC sustain pulse to be applied in the sustain period is shifted 180° for each field.

As is clearly understood from the foregoing aspects, according to the present invention, a plurality of X electrodes and a plurality of Y electrodes are alternately arranged parallel to each other on one of two, front and rear insulating substrates opposing each other, and a plurality of data electrodes are arranged on the other insulating substrate to cross the X and Y electrodes at right angles. In this arrangement, display is performed depending on whether discharge is simultaneously caused between all the adjacent X and Y electrodes. Therefore, progressive (non-interlaced) display can be performed between all the adjacent X and Y electrodes unlike the prior art in which display can be performed only in one (discharge gap) of the gaps between the X and Y electrodes, or display can be performed between all the X and Y electrodes only by interlacing.

The above and many other objects, features and advantages of the present invention will become manifest to those skilled in the art upon making reference to the following detailed description and accompanying drawings in which preferred embodiments incorporating the principle of the present invention are shown by way of illustrative examples.

BEST MODE OF CARRYING OUT THE INVENTION

Figure 8:
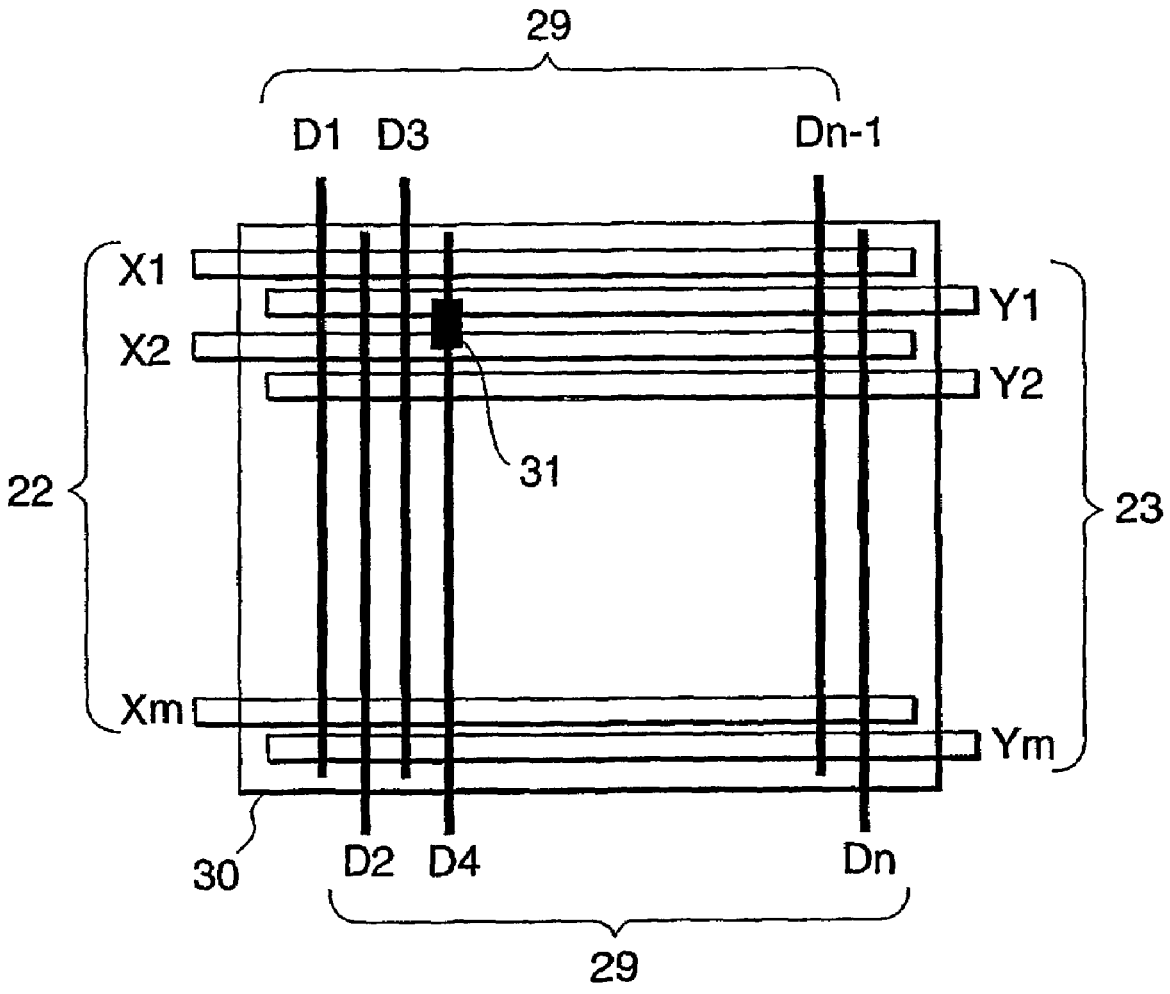
FIG. 8 is a plan view showing a three-electrode AC plasma display panel according to the first embodiment of the present invention.
Figure 9:
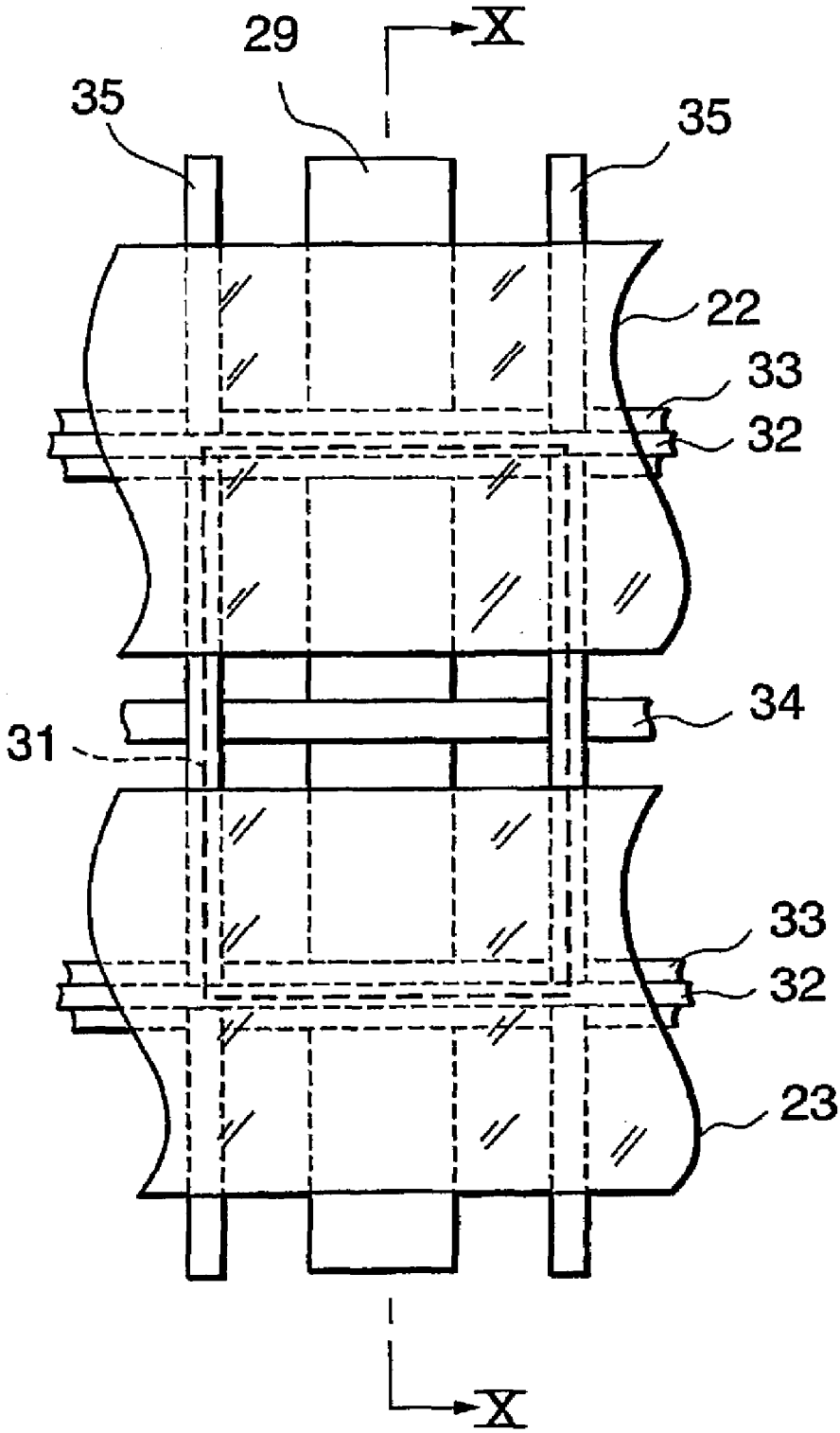
FIG. 9 is a plan view showing a cell in the first embodiment of the present invention.
Figure 10:
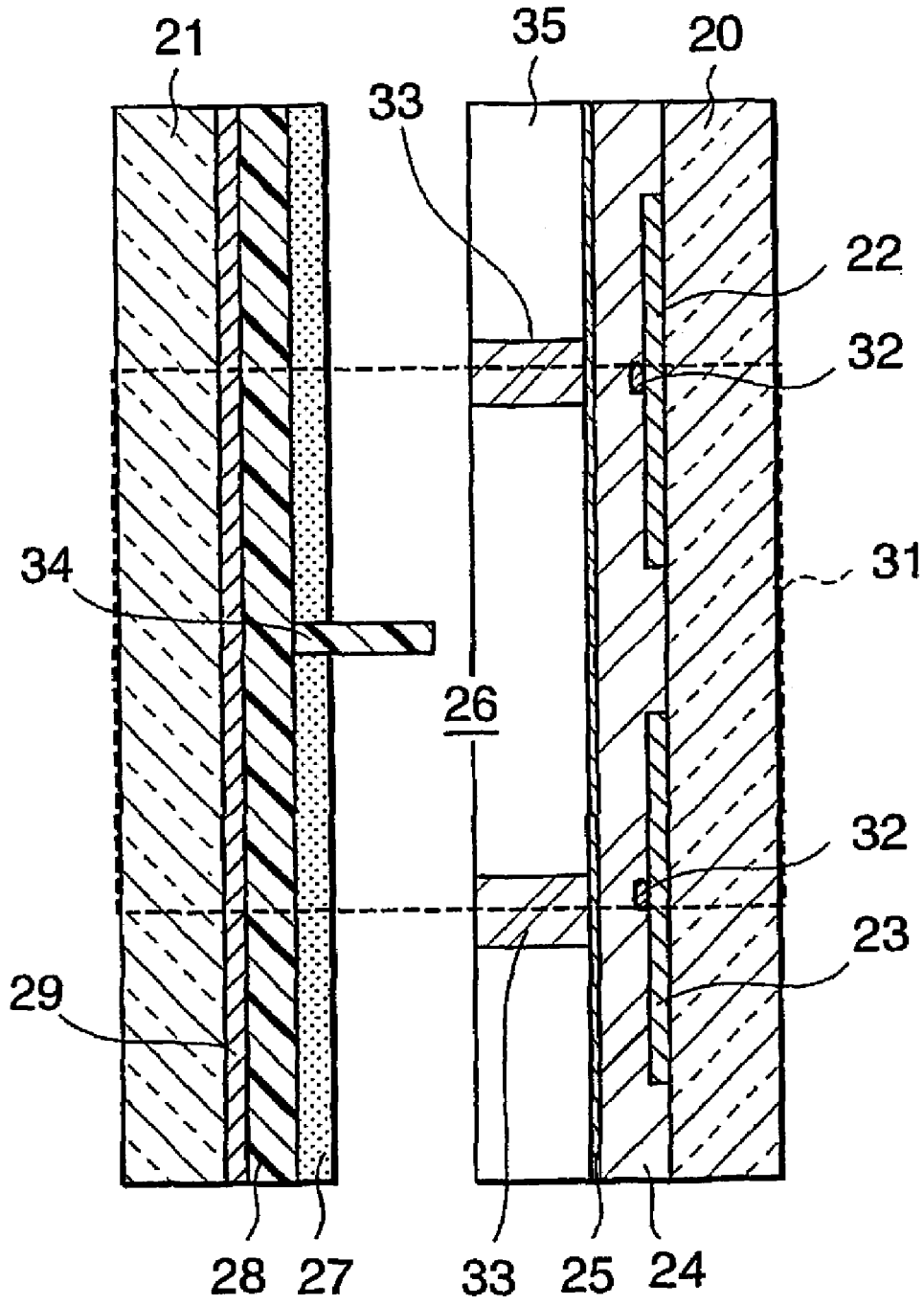
FIG. 10 is a sectional view taken along a line X—X in FIG. 9.

Several preferred embodiments of the present invention will be described below with reference to the accompanying drawings. FIG. 8 is a plan view showing a three-electrode AC plasma display panel according to the first embodiment of the present invention. Referring to FIG. 8, m X electrodes 22 and m Y electrodes 23 are alternately arranged at equal intervals. Cells 31 are formed at the intersections of all the X and Y electrodes (2m−1 electrodes) and data electrodes (n electrodes), and (2m−1)×n pixels exist. FIG. 9 is a plan view of one cell. One cell 31 is enclosed within the dashed line. FIG. 10 is a sectional view taken along a line X—X in FIG. 9. As upper and lower substrates, i.e., front and rear insulating substrates 20 and 21, for example, soda lime glass substrates each having a thickness of about 2 to 5 mm are used. Transparent electrodes, each made of tin oxide or indium oxide and having a thickness of about 100 nm to 500 nm, are formed as the X and Y electrodes 22 and 23 in pairs on the upper insulating substrate 20 as the front substrate. If, for example; the cell pitch is 0.6 mm, the line width of each of the X and Y electrodes 22 and 23 is set to about 500 to 550 μm, and the gap (discharge gap) between two electrodes is set to about 50 to 100 μm.

A metal electrodes 32 made of Ag or the like and having a thickness of about 2 to 7 μm is formed on a portion of the upper surface of each transparent electrode 22 or 23 to decrease the wiring resistance. A transparent dielectric layer 24 having a thickness of about 10 to 50 μm is formed on the resultant structure by using a $PbO—B_2O_3—SiO_2$-based low-melting glass paste having a relative dielectric constant of about 10 to 25 and is calcined at about 500 to 600 degrees of Celsius thermometer. In addition, a protective layer 25 for protecting the transparent dielectric layer 24 is formed thereon to have a thickness of about 0.5 to 2 μm by vapor deposition of MgO. A cell separation partition wall 33 having a height (50 to 65 μm) about ½ the cell gap (100 to 130 μm) runs parallel to each metal electrodes 32. This cell separation partition wall 33 and a vertical line partition wall 35 having a height about ½ the cell gap on the upper insulating substrate 20 as the front substrate are simultaneously formed by sandblasting.

A data electrode 29 made of Ag or the like and having a thickness of about 2 to 4 μm is formed on the lower insulating substrate 21 as the rear substrate. A white dielectric layer 28 is formed on the data electrode 29. The white dielectric layer 28 is formed to have a thickness of about 5 to 40 μm by using a white glass paste obtained by mixing $TiO_2$ into a $PbO—B_2O_3—SiO_2$-based low-melting glass paste having a relative dielectric constant of about 10 to 25 at a ratio of 10:1, and is calcined at 500 to 600 degrees of Celsius thermometer. Subsequently, the half of the partition wall 35 which is located on the lower insulating substrate 21 and a discharge separation partition wall 34 are formed by sandblasting. A phosphor layer 27 having a thickness of about 10 to 15 μm is formed on the resultant structure by coating. If R, G, and B (Red, Green, and Blue) phosphor layers are formed on the respective cells by coating, full-color display can be realized. (Y, Gd) $BO_3$:Eu is used for an R (red) phosphor; $Zn_2 2SiO_4$, for a G (green) phosphor; and $BaMgAl_{10}O_{17}$:Eu, for a B (blue) phosphor.

The above two insulating substrates are bonded to each other and baked at 350 to 500 degrees of Celsius thermometer. Thereafter, the cells are evacuated, and a gas mixture of He, Ne, and Xe is sealed in each cell at 200 to 600 torr, thus completing a plasma display panel.

Figure 1:
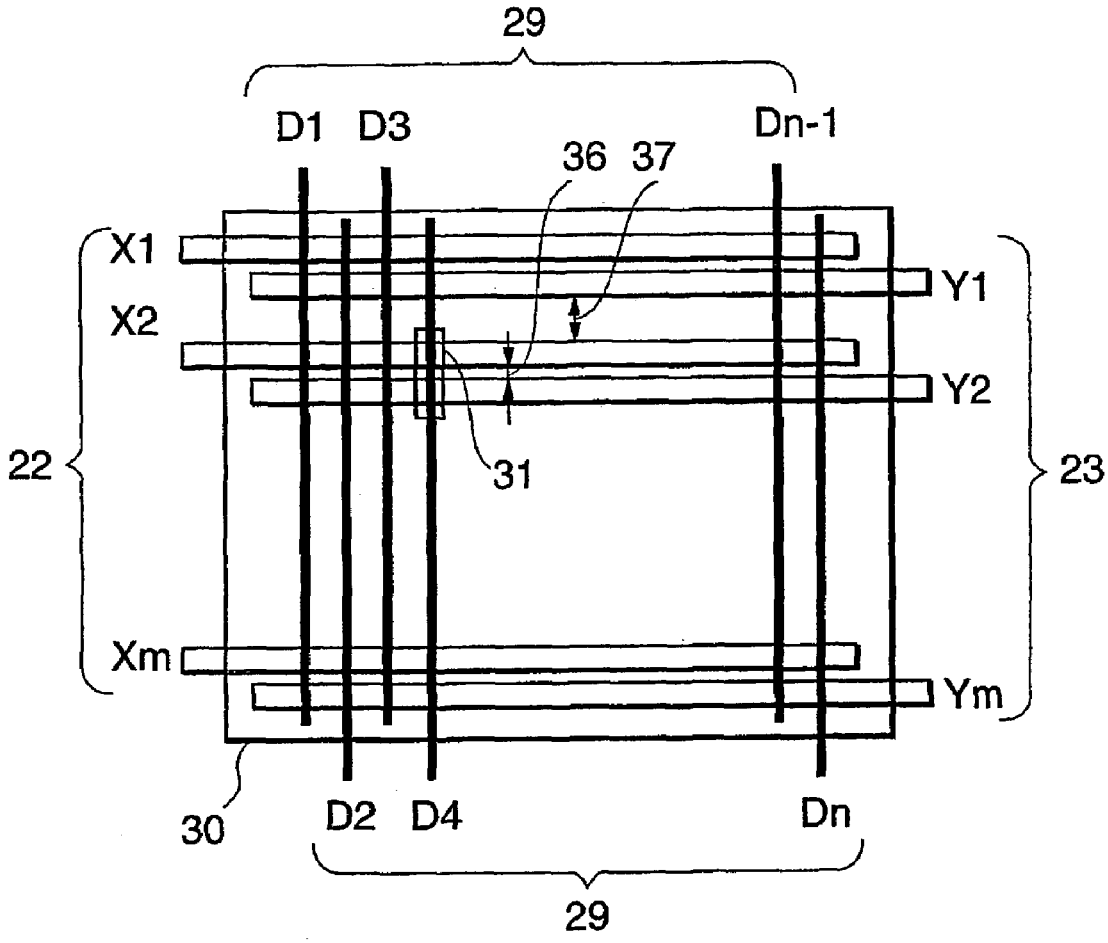
FIG.1 PRIOR ART
FIG. 1 is a plan view showing a conventional three-electrode AC plasma display panel.
Figure 2:
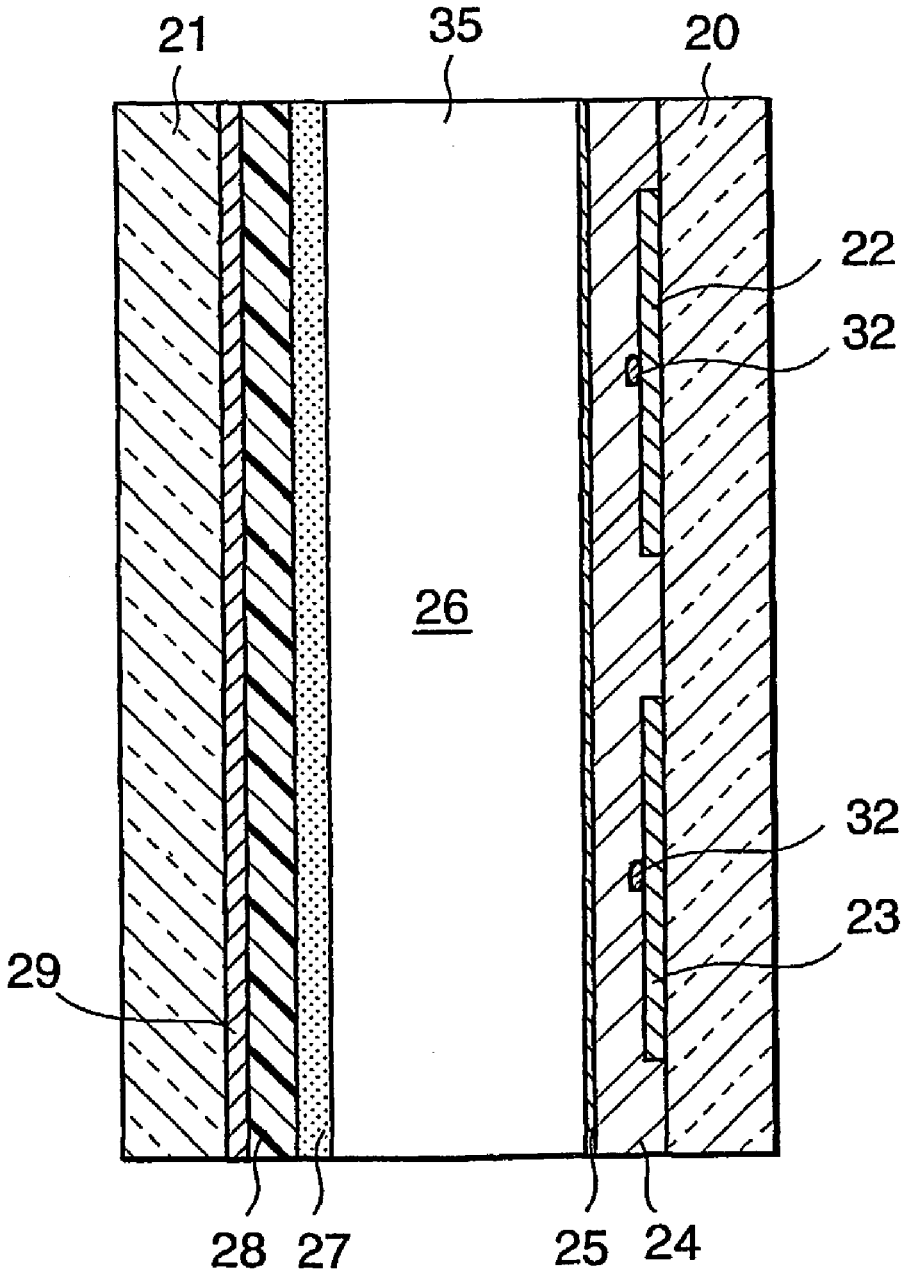
FIG.2 PRIOR ART
FIG. 2 is a sectional view showing a cell in the conventional three-electrode AC plasma display panel.
Figure 3:
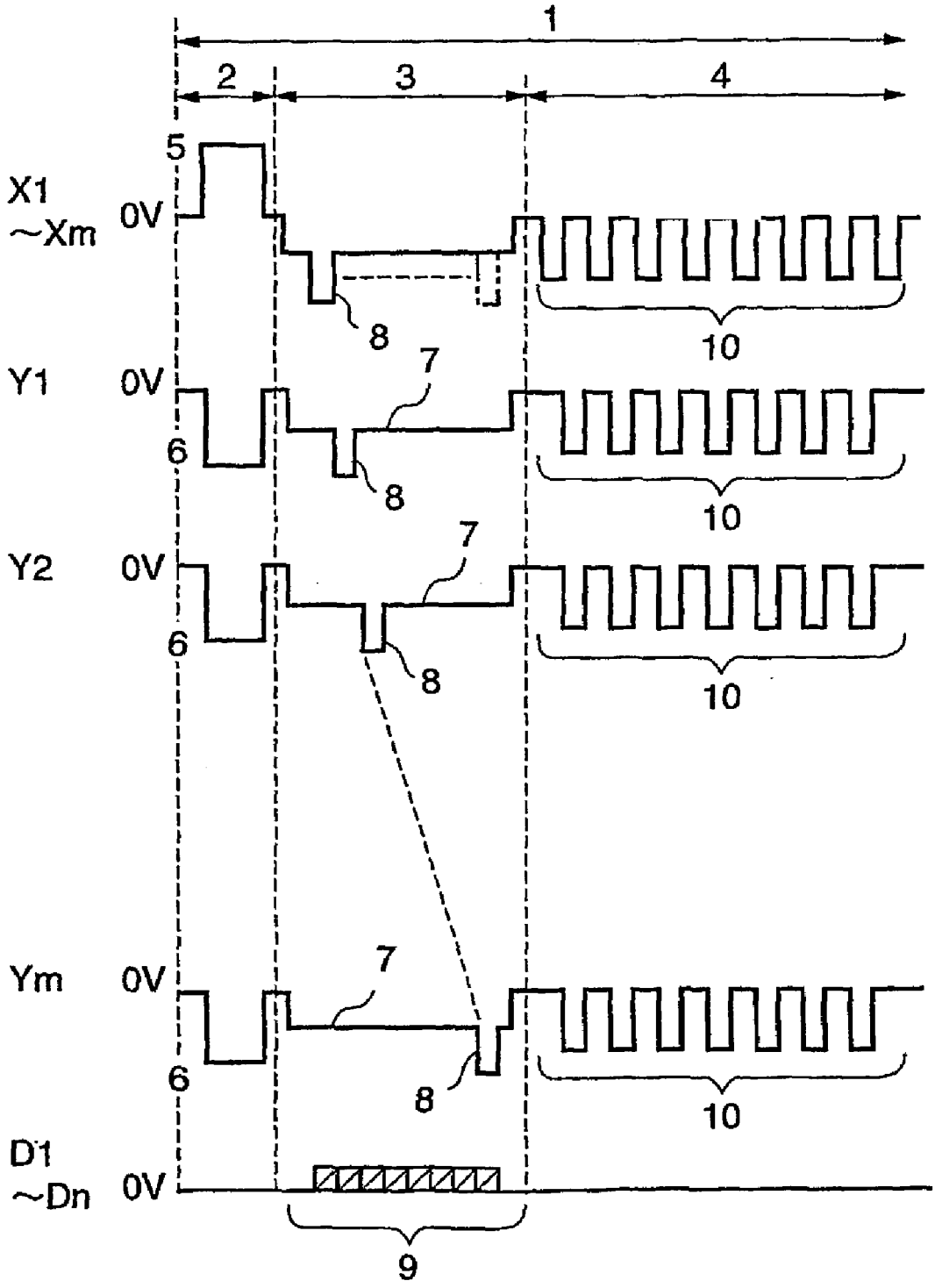
FIG.3 PRIOR ART
FIG. 3 is a timing chart showing driving waveforms for the conventional three-electrode AC plasma display panel.
Figure 4:
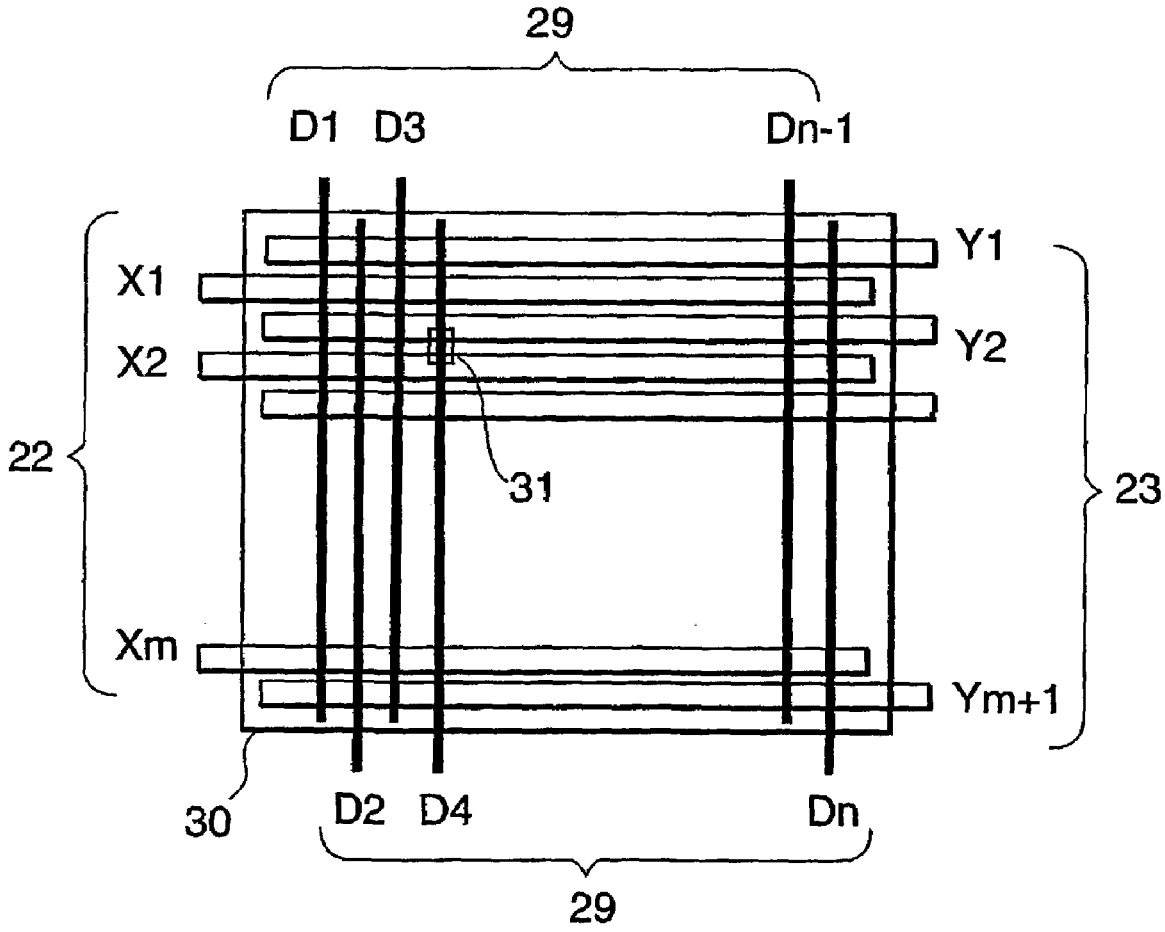
FIG.4 PRIOR ART
FIG. 4 is a plan view showing another conventional three-electrode AC plasma display panel.
Figure 5:
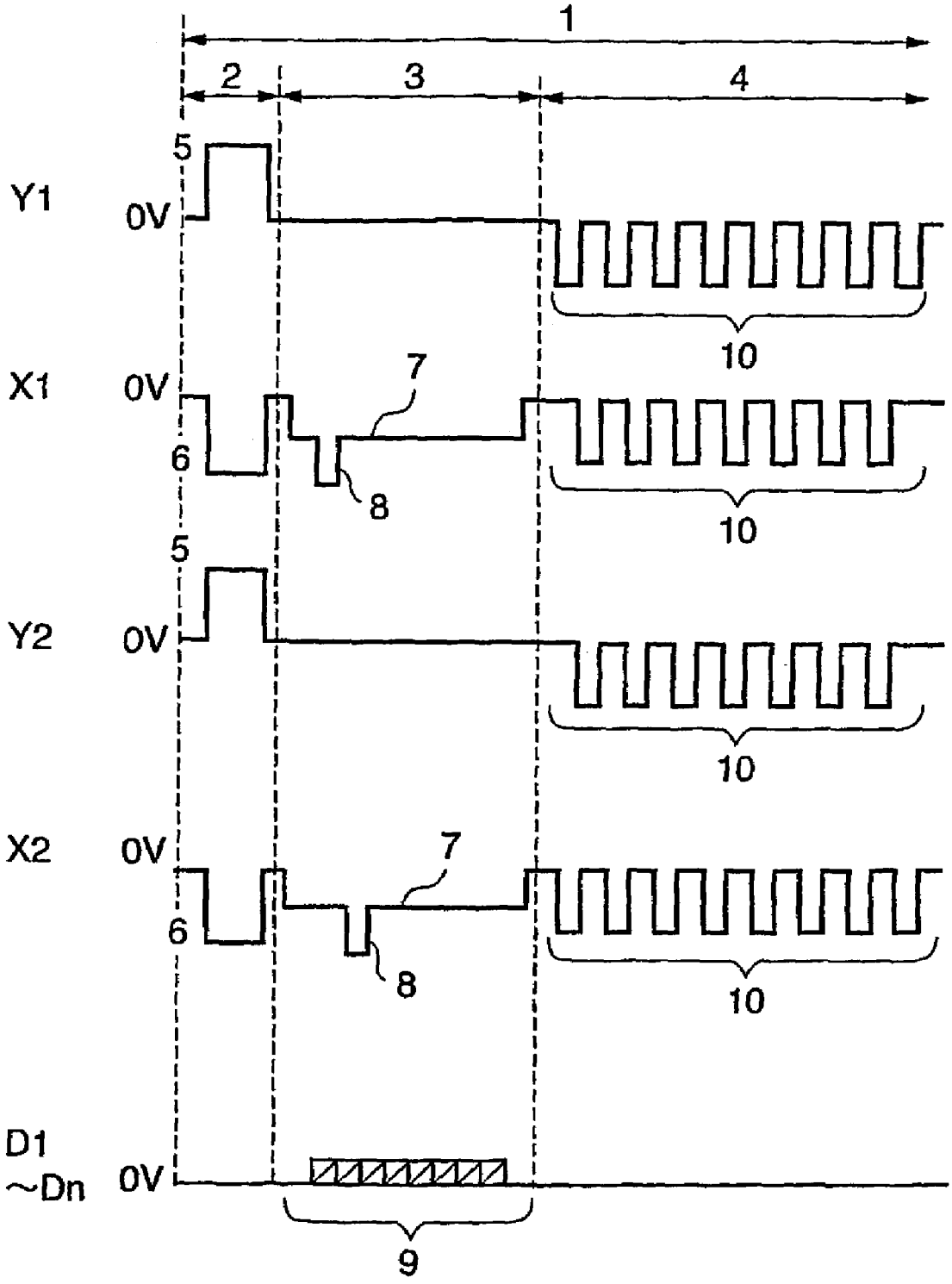
FIG.5 PRIOR ART
FIGS. 5 and 6 are timing charts respectively showing driving waveforms in odd- and even-numbered fields in the conventional three-electrode AC plasma display panel in FIG. 4.
Figure 6:
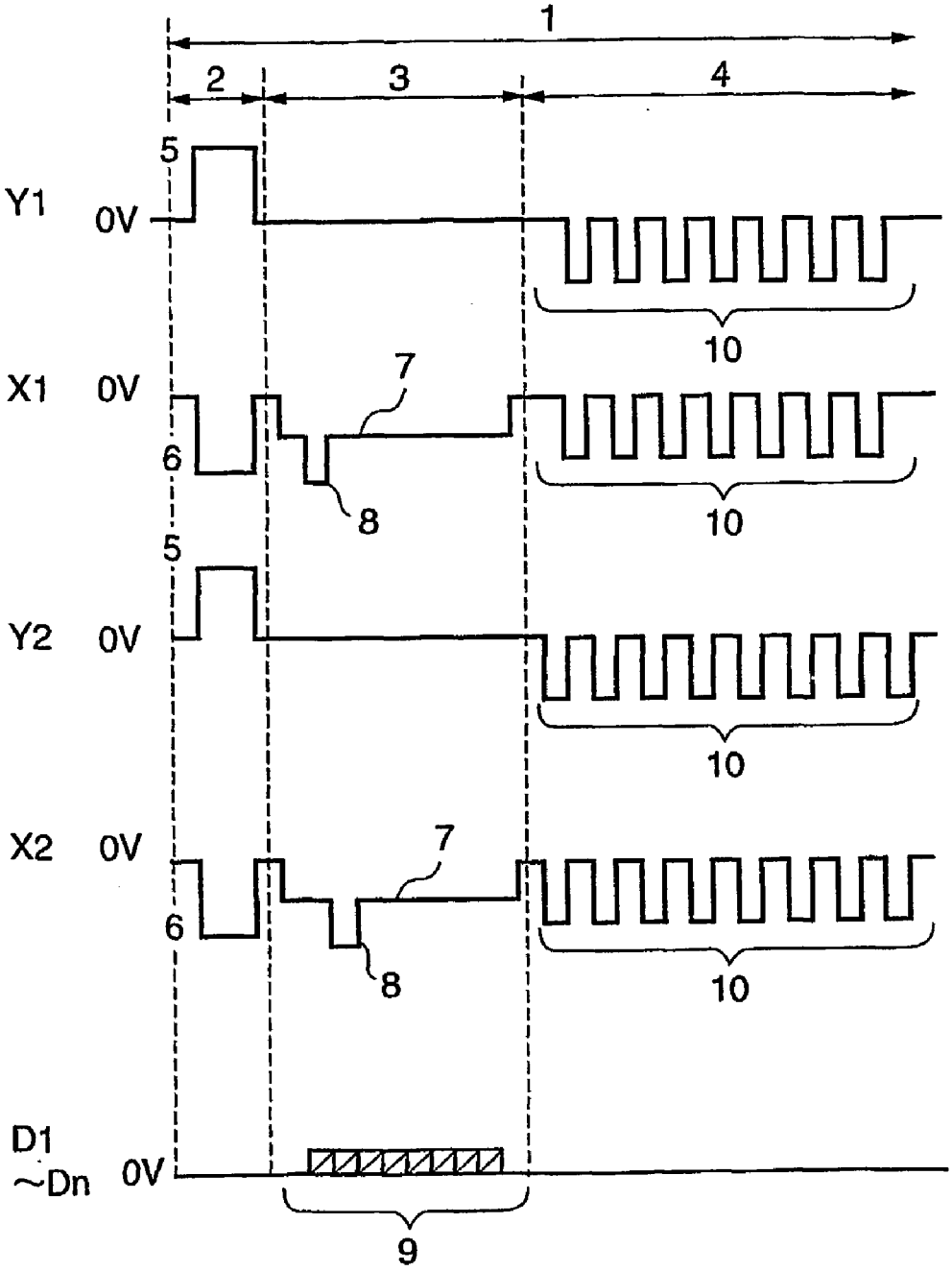
FIG.6 PRIOR ART
Figure 7:
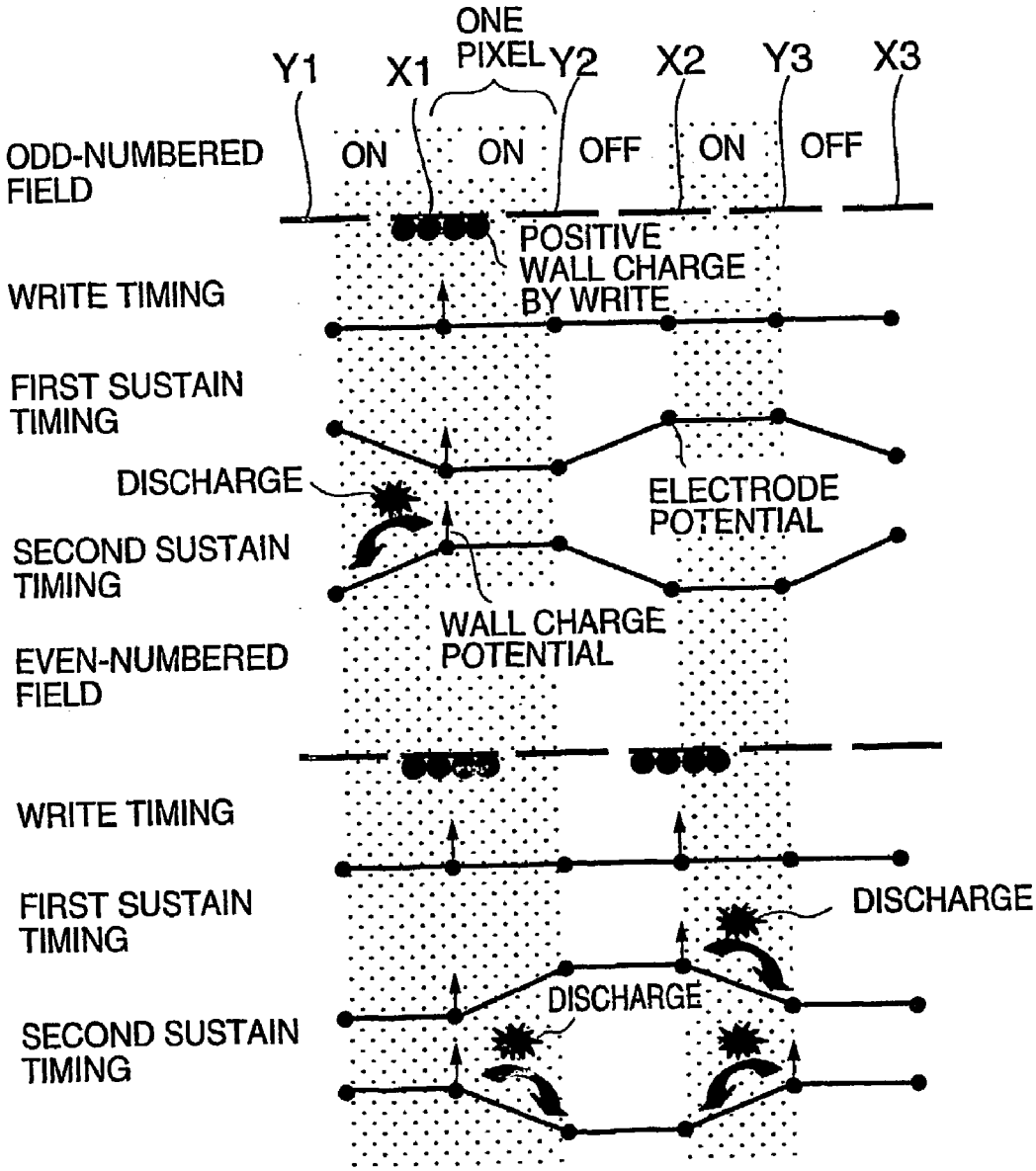
FIG.7 PRIOR ART
FIG. 7 is a schematic view showing the relationship between wall charge and discharge at the write and sustain timings in the conventional three-electrode AC plasma display panel in FIG. 4.

A method of driving the plasma display panel according to the first embodiment of the present invention will be described next. A priming period 2 is the same as in the prior art shown in FIG. 3. The voltage of a positive priming pulse 5 is set to 200 V. The voltage of a negative priming pulse 6 is set to −200 V. The pulse width is set to 4 to 6 μsec. The priming period 2 then shifts to an address period 3. An address bias pulse 7 having a voltage of about 50 to 90 V is applied to the X electrode 22 and Y electrode 23 during the address period 3. An address pulse 8 is set to about 180 V and sequentially applied to the X and Y electrodes 22 and 23 alternately in the order of X1, Y1, X2, and Y2. The address pulse width is set to 2.0 to 3.0 μsec. In synchronism with the address pulse 8, a data pulse 9 corresponding to a video signal is applied. The data pulse voltage is set to 80 V. When application of the address pulse 8 to all the electrodes is complete, the address period 3 shifts to a sustain period 4. In the sustain period 4, as a sustain pulse 10, a pulse having a negative voltage is applied to the X and Y electrodes 22 and 23 alternately. The sustain pulse voltage is set to −160 V.

Figure 12:
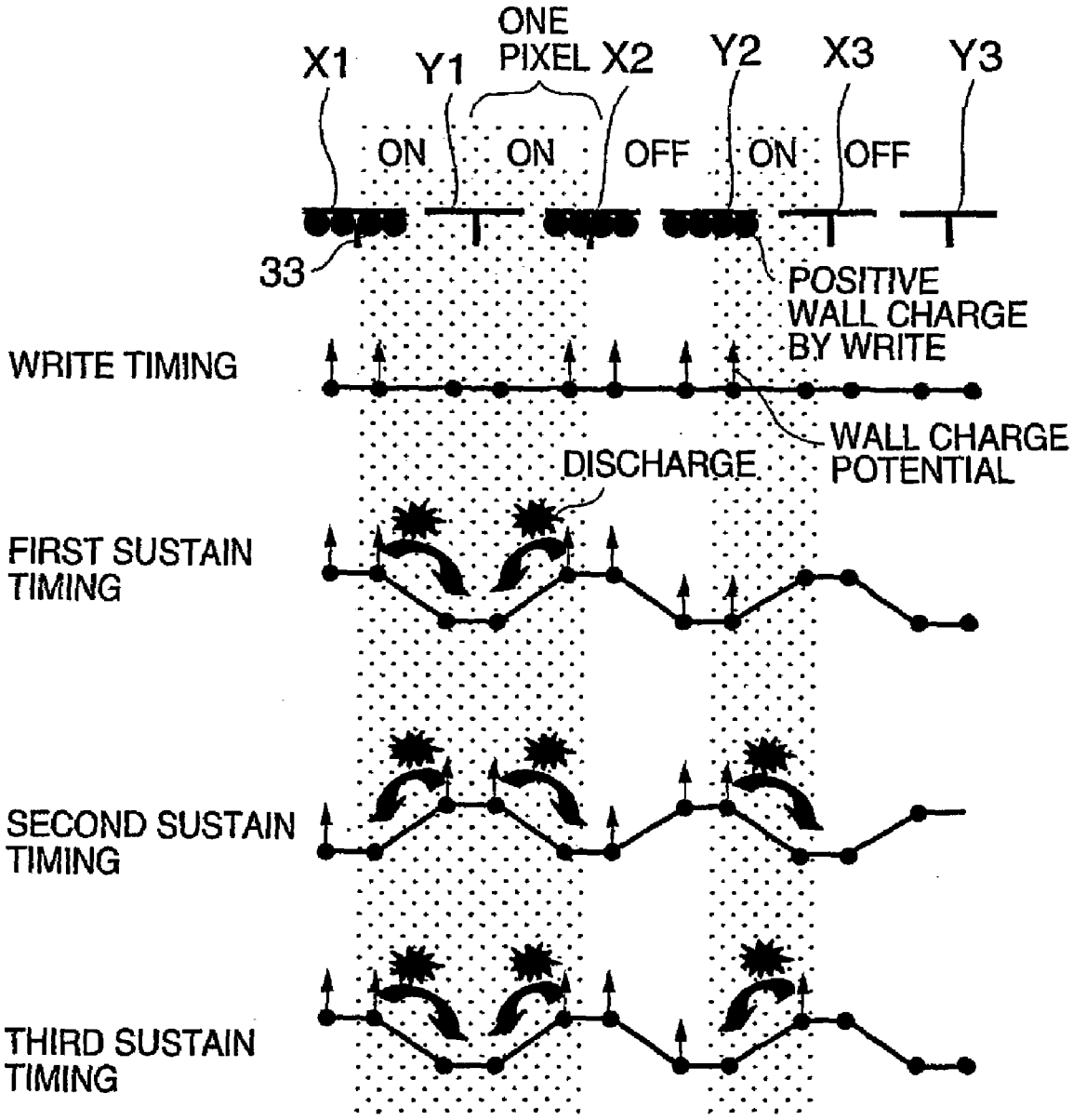
FIG. 12 is a schematic view showing the relationship between wall charge and discharge at the write and sustain timings in the first embodiment of the present invention.

The operation in this case will be described next. The operation in the priming period 2 is the same as in the prior art, and hence a repetitive description will be avoided. When the priming period 2 comes to an end, the address period 3 starts. In the address period 3, the address pulse 8 is applied to each line of the X and Y electrodes 22 and 23, and the corresponding data signal is synchronously applied as the data pulse 9 to the data electrode 29. When the data pulse 9 is applied, writing discharge occurs to form wall charge. FIG. 12 shows how the data pulse 9 is applied in this case. Referring to FIG. 12, electrodes X1 to Y3 are placed in a line on a given data electrode in FIG. 8. In the case shown in FIG. 12, ON/OFF display like that indicated at the upper portion in the drawing is performed.

The electrode to be addressed first in the address period 3 is irrelevant to display, and hence writing discharge may or may not be caused at this electrode. In this embodiment shown in FIG. 12, writing discharge is caused at the electrode X1. The flow of this processing then shifts to the electrode Y1. In FIG. 12, pixels adjacent to each other in the vertical direction are shown left to right. In the driving method of the present invention, in an ON pixel, the respective pixel pair of X and Y electrodes 22 and 23 are set in different wall charge states in the write operation, which is when data pulse 9 is applied to data electrode 29. For example, referring to FIG. 12, the pixel framed by X1 and Y1 is ON, and said two electrodes have different wall charge states. Likewise, the pixel framed by Y1 and X2 is ON, and these two electrodes also have different wall charge states. In an OFF pixel, electrodes are set to the same wall charge state. At the electrode Y1, data pulse 9 results in no writing discharge being caused. Likewise, writing discharge is caused at the electrodes X2 and Y2, but no writing discharge is caused at the electrodes X3 and Y3. The wall charge potentials formed by writing discharge, by application of data pulse 9 via electrode 29 are indicated at the "write timing" by the arrows in FIG. 12. FIG. 12 shows electrode and wall charge potentials from the write timing to the third sustain timing. When application of the address pulse 8 to all the lines is complete, and the data pulses 9 are complete, then the first sustain timing period 4 starts. FIG. 12 shows the second wall charge potential from the previous sustain timing sequence and sustain discharges superimposed upon the second sustain timing. As shown in FIG. 12, the polarity of subsequent sustaining periods is 180 degrees out of phase from the previous sustain timing.

Figure 11:
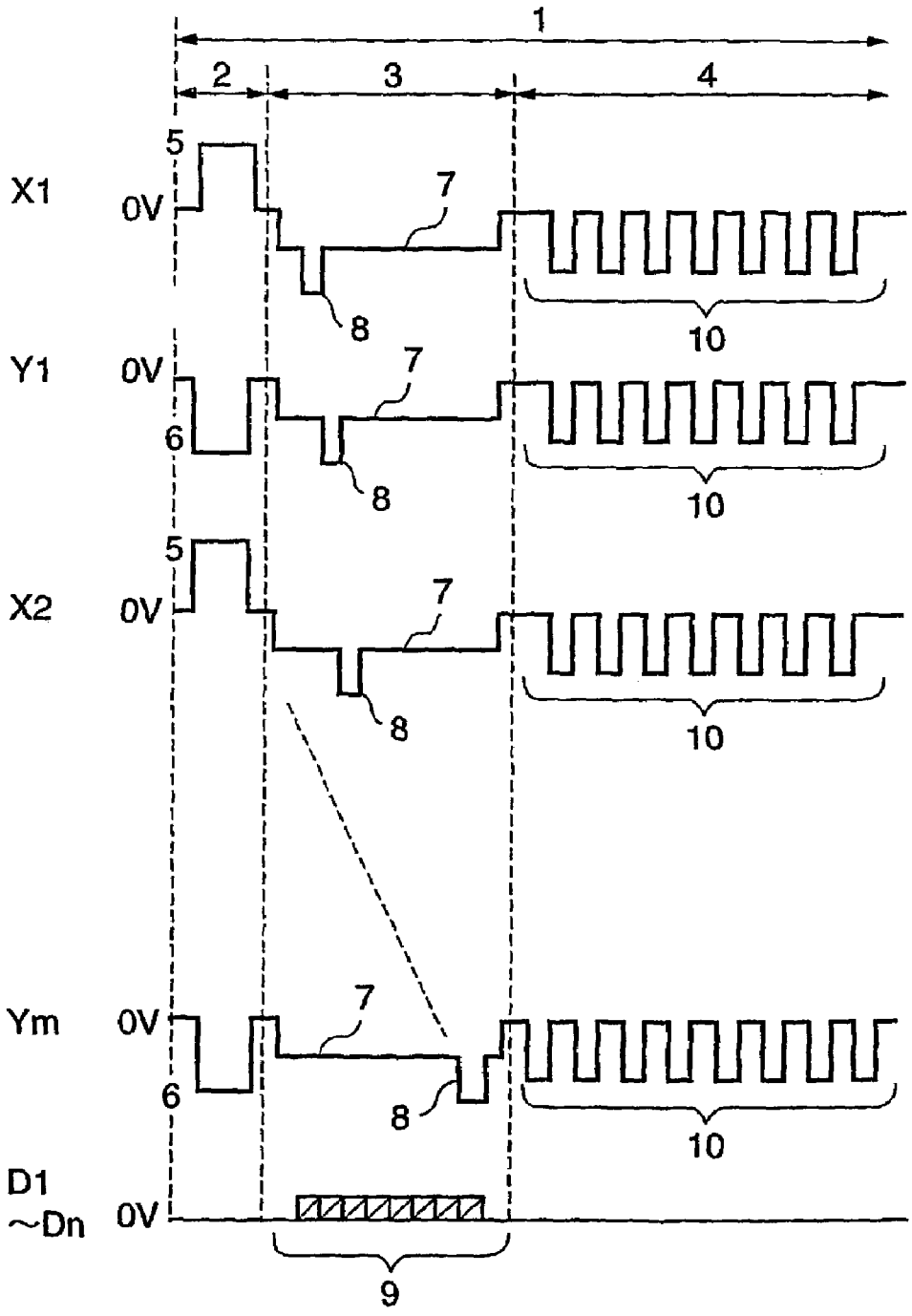
FIG. 11 is a timing chart showing driving waveforms in the first embodiment of the present invention.

Further describing the progressive display, in the sustain period 4, the negative sustain pulse 10 is applied to the X and Y electrodes 22 and 23 alternately. In the embodiment shown in FIGS. 11 and 12, the sustain pulse is applied to the Y electrode 23 (Y1) first. As shown in FIG. 12, at the first sustain timing at which the first sustain pulse is applied, large potential differences occur between the electrodes X1 and Y1 and between the electrodes Y1 and X2, thus causing sustain discharge. Owing to this sustain discharge, the wall charge at the electrodes X1 and the wall charge at X2 move to the electrode Y1, shown at electrode Y1 during the second sustain timing. In this case, since the cell separation partition wall 33 is formed at the center line of each of the X and Y electrodes 22 and 23, the wall charge (from the sustain discharge) moves only to the opposite cell separation partition wall 33 in the same cell.

Continuing to describe the progressive display shown in FIG. 12. using the configuration shown display configuration of FIG. 10, the flow of processing then shifts to the second sustain timing. At the second sustain timing, large potential differences occur between the electrodes X1 and Y1, Y1 and X2, and Y2 and X3 to cause sustain discharge. At the third sustain timing, sustain discharge occurs in the same place upon reversal of the polarity. Subsequently, the second and third sustain timings are alternately provided to maintain sustain discharge. Although no sustain discharge occurs between the electrodes Y2 and Y3 only at the first sustain timing, if, however, the number of sustain pulses is large, that the number of times of sustain discharge is smaller than that in the prior art by one falls within an error range.

In this manner, progressive (non-interlaced) display can be performed between all the X and Y electrodes 22 and 23 unlike the prior art in which display can be performed only in one (discharge gap 36) of the gaps between the X and Y electrodes 22 and 23, or display can be performed between all the X and Y electrodes 22 and 23 only by the interlaced scheme.

Figure 13:
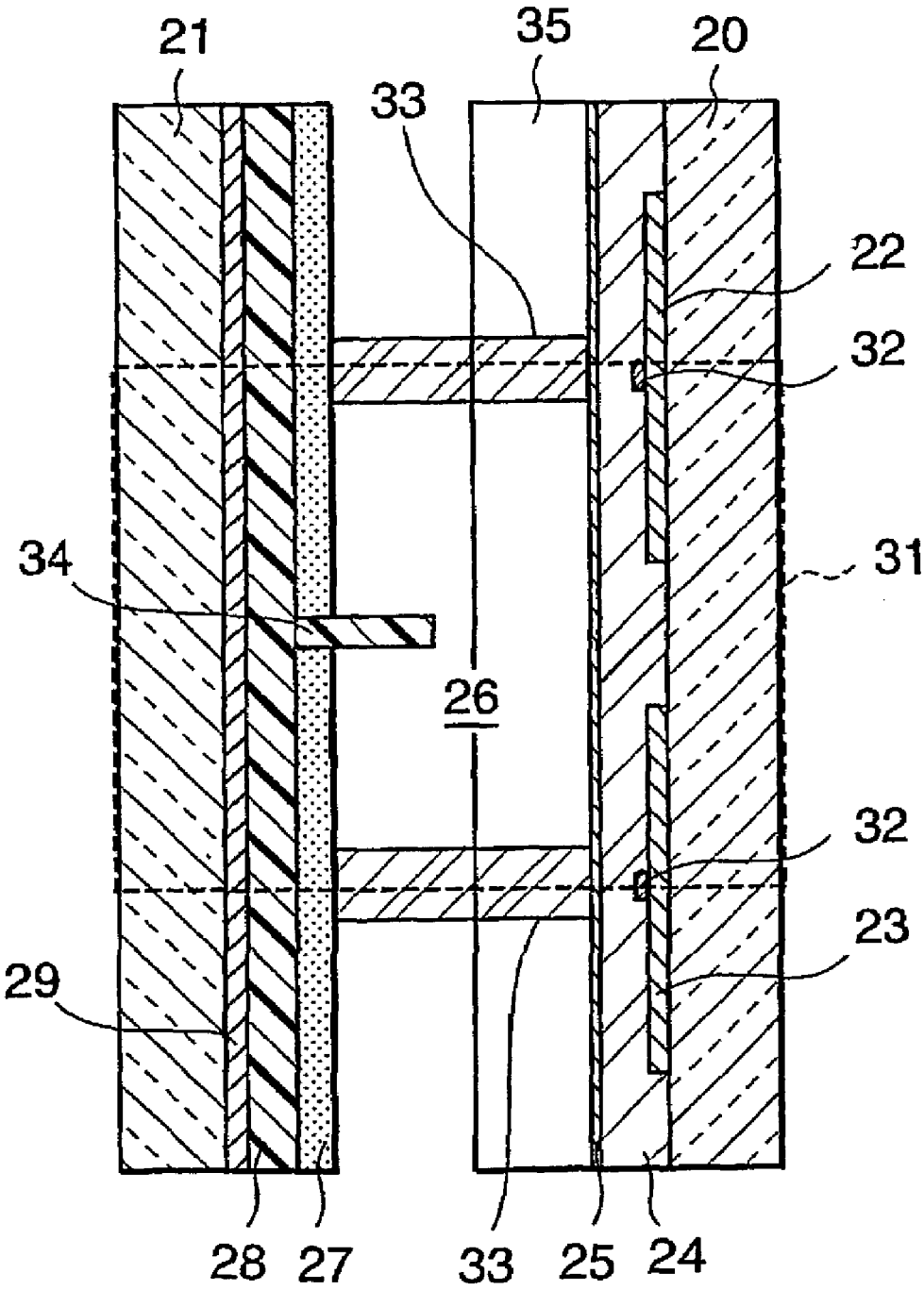
FIG. 13 is a plan view showing one cell in the second embodiment of the present invention.

The second embodiment of the present invention will be described with reference to FIG. 13. FIG. 13 is a sectional view showing one cell in the second embodiment of the present invention. The driving method in this embodiment is the same as that in the first embodiment. The arrangement of the second embodiment is the same as that of the first embodiment except that cell separation partition walls 33 are also formed on a lower insulating substrate 21. By forming the cell separation partition walls 33 on the lower insulating substrate 21 as well, each cell is enclosed within partition wall on every side. Although it takes time to evacuate each cell and seal a gas therein, discharges in adjacent cells can be perfectly separated from each other. This makes it possible to prevent erroneous ON/OFF operation.

Figure 14:
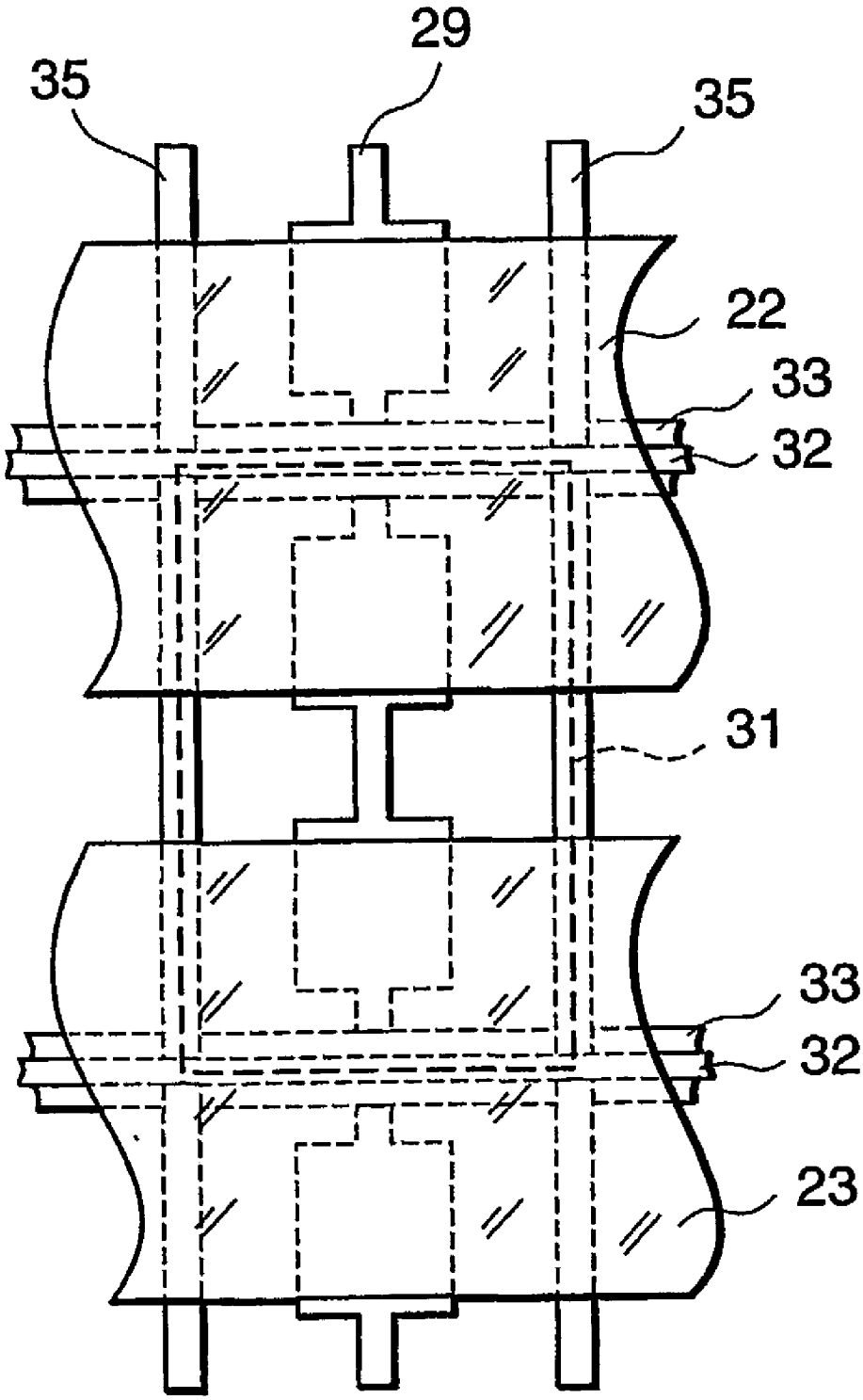
FIG. 14 is a plan view showing one cell in the third embodiment of the present invention.

The third embodiment of the present invention will be described with reference to FIG. 14. FIG. 14 is a plan view of one cell in the second embodiment of the present invention. The driving method in this embodiment is the same as that in the first embodiment. In this embodiment, instead of using the discharge separation partition walls 34, the line width of each data electrode 29 is decreased except for portions where writing discharge is caused. The line width of each thin portion of the data electrode 29 is set to 20 to 30 μm. Each discharge separation partition wall 34 prevents negative wall charge from spreading on the data electrode 29 in write operation, which is caused when opposing discharge spreads to the adjacent X or Y electrode 22 or 23 in each cell along the data electrode 29. Spreading of the charge onto the data electrode 29 opposing the electrode to which the next address pulse 8 is applied will make it difficult to cause writing discharge when the address pulse 8 is applied next. To prevent this, the width of each portion of the data electrode 29 which opposes a discharge gap is decreased.

Figure 15:
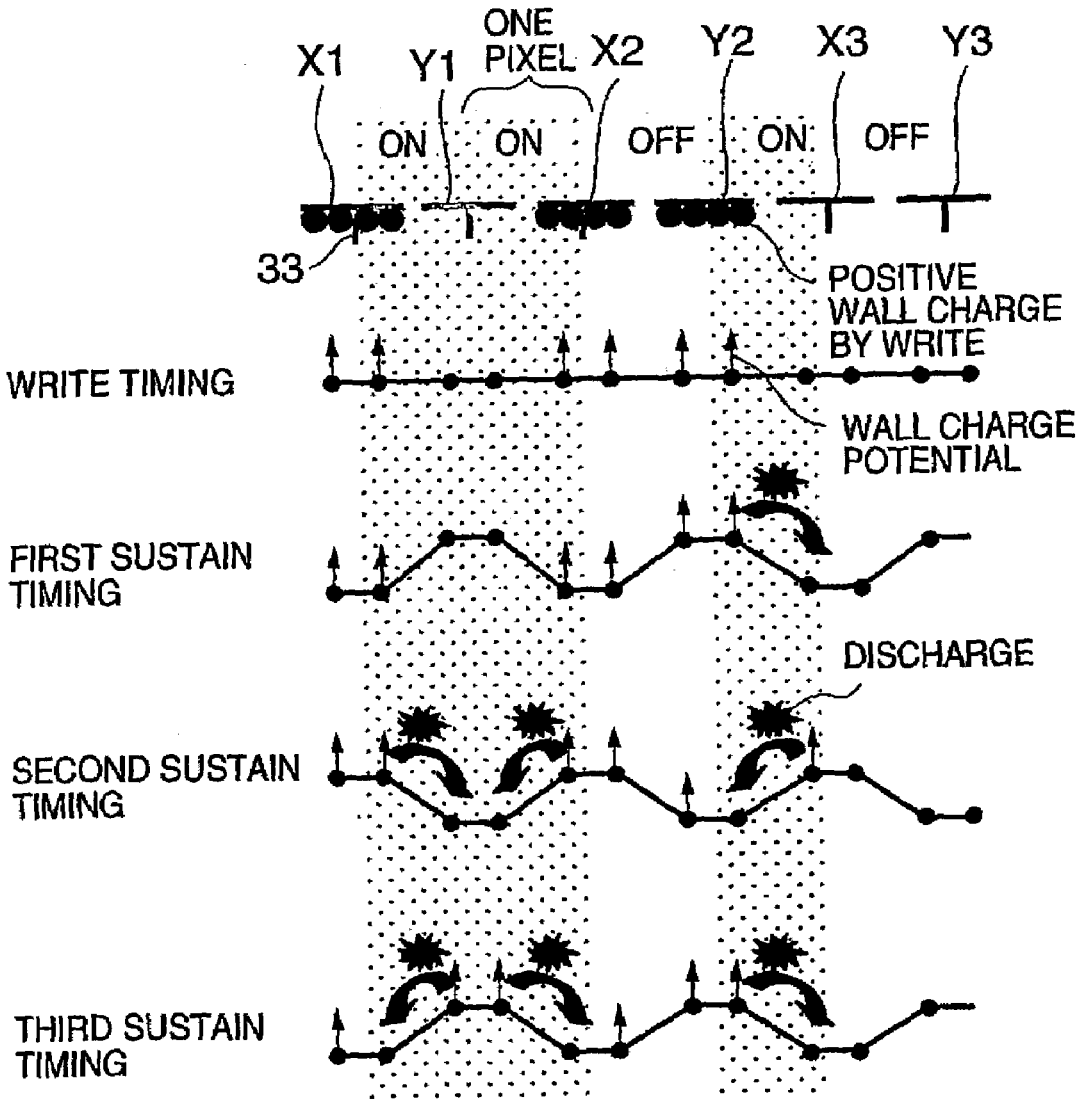
FIG. 15 is a schematic view showing the relationship between wall charge and discharge at the write and sustain timings in the fourth embodiment of the present invention.

The fourth embodiment of the present invention will be described with reference to FIGS. 12 and 15. The panel structure, cell structure, priming period 2, and address period 3 in this embodiment are the same as those in the first embodiment. FIG. 12 is a conceptual rendering of wall charge and discharge at the write and sustain timings in an odd-numbered field according to the fourth embodiment of the present invention. FIG. 15 is a conceptual rendering of wall charge and discharge at the write and sustain timings in an even-numbered field. As in the first embodiment of the present invention, even in an ON pixel, sustain discharge may not occur upon application of the first sustain pulse depending on display data. To cancel out this one discharge error (luminance error), the phase of a sustain pulse 10 is reversed 180° for each frame. In the case shown in FIG. 12, application of a negative pulse is started from a Y electrode 23. In contrast to this, in the case shown in FIG. 15, application is started from an X electrode.

In this display example, in an odd-numbered field, the fourth pixel from the left is an ON pixel, but no discharge occurs at the first sustain timing. In an even-numbered field, however, discharge occurs at the first sustain timing. In contrast to this, although the first and second pixels are ON pixels, no discharge occurs at the first sustain timing in the even-numbered field. In the odd-numbered field, however, discharge occurs at the first sustain timing. When the same display operation is performed in odd- and even-numbered fields in this manner, discharge does not occur in each ON pixel in either odd-numbered field or even-numbered field. That is, there is no ON pixel in which discharge always fails to occur. This makes it possible to suppress variations in display.

Figure 16:
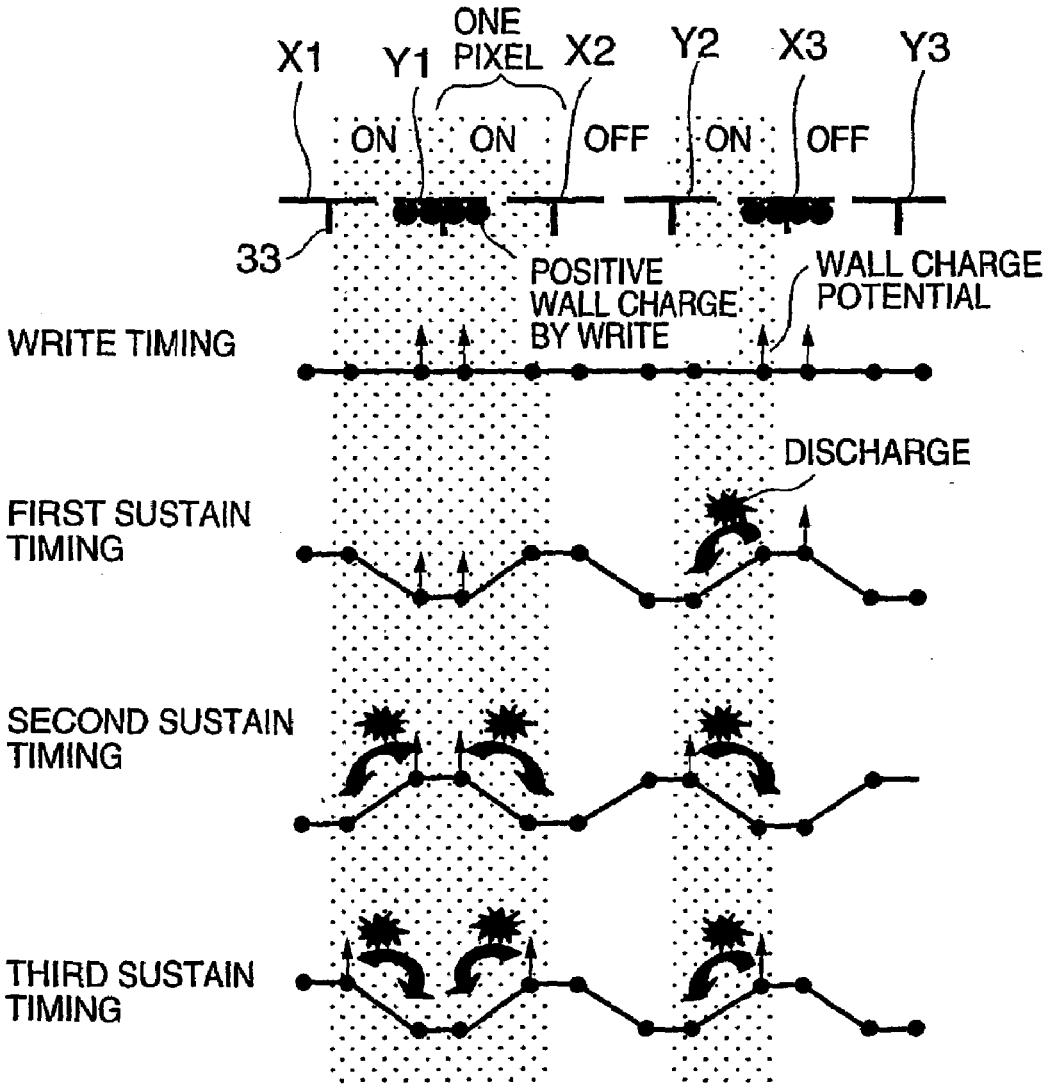
FIG. 16 is a schematic view showing the relationship between wall charge and discharge at the write and sustain timings in the fifth and sixth embodiments of the present invention.

The fifth embodiment of the present invention will be described with reference to FIGS. 12 and 16. The panel structure, cell structure, and priming period 2 in this embodiment are the same as those in the first embodiment. FIG. 12 is a conceptual rendering of wall charge and discharge at the write and sustain timings in an odd-numbered field according to the fifth embodiment of the present invention. FIG. 16 is a conceptual rendering of wall charge and discharge at the write and sustain timings in an even-numbered field. As in the first embodiment of the present invention, even in an ON pixel, sustain discharge may not occur upon application of the first sustain pulse depending on display data. To cancel out this one discharge error (luminance error), the write state of an electrode X1 is changed for every frame. In the first embodiment of the present invention, writing discharge is always caused at the electrode X1. In contrast to this, in the fifth embodiment of the present invention, write operation is performed at the electrode X1 in an even-numbered field, but no write operation is performed at the electrode X1 in an even-numbered field. Write operation after the electrode X1 is determined by the write operation at the electrode X1. If the same display is to be performed, the formation state of wall charge is reversed depending on whether writing discharge is caused at the electrode X1. This makes it possible to realize the same display as that in the fourth embodiment of the present invention even if the phase of a sustain pulse in the sustain period 4 remains the same.

The sixth embodiment of the present invention will be described with reference to FIGS. 12 and 16. The panel structure, cell structure, and priming period 2 in this embodiment are the same as those in the first embodiment. FIG. 12 is a conceptual rendering of wall charge and discharge on odd-numbered data electrode lines D1, . . . , Dn−1 at the write and sustain timings according to the sixth embodiment of the present invention. FIG. 16 is a conceptual rendering of wall charge and discharge on even-numbered electrode lines D2, . . . , Dn at the write and sustain timings in an even-numbered field. In the fourth and fifth embodiments, variations in luminance are canceled out temporally. In the sixth embodiment, variations in luminance are canceled out between, for example, D1 and D2 spatially. The operation of this embodiment is the same as that in the fifth embodiment.

What is claimed is:

1. A driving method for a three-electrode AC plasma display panel in which a plurality of X electrodes and a plurality of Y electrodes are alternately arranged parallel to each other on one of two, front and rear insulating substrates opposing each other, and a plurality of data electrodes are arranged on the other insulating substrate to cross the X and Y electrodes at right angles, comprising the steps of:

causing the discharge ON of cells within a first set of cells and the discharge ON of cells within a second set of cells vertically adjacent to the first set of cells, wherein each set of cells comprises cells framed by an X electrode and an adjacent Y electrode and having one of the two electrodes in common with the other set of cells, an address pulse has been sequentially applied to the X electrode and the Y electrode, and said address pulse is applied in synchronization with an application of a data pulse to a data electrode, to generate writing discharge in the address period at the electrode to which the address pulse was applied;

applying AC sustain pulses to the X and Y electrodes alternately in the sustain period; and performing progressive display in dependence on the occurrence of a discharge, caused between respective pairs of X and Y electrodes in said two vertically adjacent sets of cells.

2. A method according to claim 1, further comprising the steps of setting an address period and a sustain period, sequentially applying an address pulse to the X and Y electrodes in the address period, applying a data pulse corresponding to display data to a data electrode in accordance with application timing of the address pulse, forming wall charge at the X and Y electrodes in accordance with the display data, applying an AC sustain pulse between the X and Y electrodes in the sustain period, and determining occurrence of sustain discharge on the basis of the amount of the wall charge, thereby performing display.

3. A method according to claim 2, wherein when ON display is to be performed by causing discharge between a corresponding pair of X and Y electrodes, different amounts of wall charge are stored in the X and Y electrodes in the address period; and when OFF display is to be performed by causing no discharge between a corresponding pair of X and Y electrodes, the same amount of wall charge is stored in the X and Y electrodes in the address period.

4. A method according to claim 2, wherein when ON display is to be performed by causing discharge between a pair of X and Y electrodes, data pulses having different voltages are respectively applied to the X and Y electrodes upon application of the address pulse to cause writing discharge at only one of the X and Y electrodes in the address period; and when OFF display is to be performed by causing no discharge between a pair of X and Y electrodes, data pulses having the same voltage are applied to the X and Y electrodes upon application of the address pulse to cause writing discharge at both or neither of the X and Y electrodes.

5. A method according to claim 2, wherein a bias voltage having the same polarity as that of the address pulse is applied to two Y or two X electrodes adjacent to an X or a Y electrode, respectively, to which the address pulse is applied in the address period.

6. A method according to claim 2, wherein in the address period, when the address pulse is applied, no surface emission is caused between the electrode to which the address pulse is applied and the X or Y electrodes adjacent to the electrode to which the address pulse is applied.

7. A method according to claim 2, wherein in the sustain period, discharge is caused between the X and Y electrodes in an ON cell every time a polarity of the AC sustain pulse is reversed, and the discharge is not caused in an OFF cell every time the AC sustain pulse is reversed.

8. A method according to claim 2, wherein one field in which one frame is displayed is constituted by a plurality of sub-fields, each of the sub-fields has a priming period in which a stored state of wall charge in each cell is initialized, the address period, and the sustain period, and gray-scale display is realized by turning on or off the sustain period in an arbitrary sub-field.

9. A method according to claim 2, wherein in the address period, the voltage of the data pulse to be applied first is changed depending on whether the data electrode is on an even- or odd-numbered line, thereby changing the presence/absence of the writing discharge.

10. A method according to claim 2, wherein in the address period, the voltage of the data pulse to be applied first is changed depending on an even- or odd-numbered field, thereby changing the presence/absence of the writing discharge.

11. A method according to claim 2, wherein a phase of the AC sustain pulse to be applied in the sustain period is shifted 180° for each field.

* * * * *